United States Patent [19]

Bailey et al.

[11] 4,433,476

[45] Feb. 28, 1984

[54] PIN INSERTION TOOL

[75] Inventors: Timothy F. Bailey, Springfield; Dennis S. Brunelle, South Hadley, both of Mass.

[73] Assignee: Combustion Engineering, Inc., Windsor, Conn.

[21] Appl. No.: 364,347

[22] Filed: Apr. 1, 1982

[51] Int. Cl.[3] ..... H01R 43/00

[52] U.S. Cl. ..... 29/752; 29/251; 29/267; 29/705; 29/747; 29/754; 29/760; 100/257; 100/266

[58] Field of Search ..... 29/747, 748, 750–752, 29/739, 760, 758, 845, 251, 267; 100/266, 283, 293, 257

[56] References Cited

U.S. PATENT DOCUMENTS

| | | | |
|---|---|---|---|
| 3,009,414 | 11/1961 | Griemert | 100/293 |
| 3,085,321 | 4/1963 | Douglas | 29/747 X |
| 3,358,332 | 12/1967 | Downey | 100/266 X |
| 3,429,039 | 2/1969 | Berg | 29/739 X |
| 3,964,147 | 6/1976 | Fusco et al. | 29/754 X |
| 4,351,109 | 9/1982 | Kelley | 29/747 |

*Primary Examiner*—Carl E. Hall

*Attorney, Agent, or Firm*—David L. Smith; Willaim W. Habelt

[57] ABSTRACT

Press element insertion apparatus (86) is a press-like apparatus used to insert pins (82) or sockets (82) into a cable connector (84). Clamp (104) is adapted to securely hold a pin (82) or socket (82) with a conductor attached for insertion into a cable connector (84). Clamp (104) readily releases the pin (82) or socket (82) after insertion into a cable connector (84) by operating lever operated cam (120) which releases movable jaw member (118). Internal springs (122) cause movable jaw member (118) to laterally release pin (82) or socket (82). The cable connector support (90,92) is a two-axis position guide that prevents cable connector (84) from rotating during cable fabrication while simultaneously providing two degrees of freedom that are necessary to insert pins (82) and sockets (82) in an array (86) of element insertion locations.

12 Claims, 6 Drawing Figures

PIN INSERTION TOOL

BACKGROUND OF THE INVENTION

This invention relates to fabricating cables and in particular to apparatus for inserting an element attached to the end of a conductor of a cable in a cable connector during fabrication.

Insertion of pins and sockets into a cable connectors in the manufacture of cables has heretofore been a manual process using hand tool. The hand tool wad either a plier-like or screwdriver-like device adapted to hold a pin or socket for manual insertion of the pin or socket into a cable connector. Using either of these hand tools is fatiguing as a force of approximately 222 newtons (50 pounds) is required to insert a pin or socket into the cable connector. These hand tools will accommodate a pin or socket with or without a conductor connected.

A manually operated press in the prior art is available to insert pins or sockets into cable connectors. However, the prior art press will accommodate only pins or sockets without conductors attached. The press reduces fatigue by providing a mechanical advantage to the operator thereby reducing the force required to insert a pin or socket into the cable connector.

When fabricating a cable, pins crimped onto one end of the cable conductors are inserted into a cable connector at that end while sockets crimped onto the other end of the cable conductors are inserted into a cable connector at that end of the cable. The pins or sockets inserted into the cable connector of the first end of the cable can be inserted without regard to location. However, when fabricating the second end of a cable, it is imperative that the location of a pin or socket in the cable connector for a given conductor corresponds to the location of the socket or pin in the cable connector for the same conductor in the first end of the cable.

Heretofore, when fabricating the second end of a cable, the appropriate location to insert a pin or socket into a cable connector was determined in the following manner. The first lead of a battery operated buzzer wired in series with a battery was placed in contact with a pin or socket in the completed cable connector of the first end of the cable. The second lead of the buzzer-battery combination was randomly placed in contact with each of the sockets or pins not inserted in a cable connector on the uncompleted second end of the cable until the buzzer sounded, signifying continuity. The socket or pin to be inserted into the cable connector of the second end of the cable was thus identified. The appropriate location to insert the socket or pin corresponds to the location of the pin or socket in the completed first end of the cable that is in contact with the first lead of the buzzer-battery combination.

A need exists for a press to insert pins or sockets into cable connectors with conductors attached to the pins or sockets. Such a press would be a part of an efficient cable manufacturing operation and would reduce the fatigue experienced when inserting pins or sockets into cable connectors and thereby reduce the time required to manufacture a cable.

SUMMARY OF THE INVENTION

The present invention fulfills the need of an apparatus for inserting a pin or socket attached to the end of a conductor of a cable into a cable connector during cable fabrication. The press element insertion apparatus of the present invention comprises a cable connector support mounted on the base which prevents the cable connector from rotating during fabrication while affording the two degrees of freedom required to insert pins or sockets in an array of element insertion locations. A clamp adapted to securely hold a pin or socket with a conductor attached is held by the press-like apparatus. The clamp is constrained to move perpendicular to the cable connector through a limited distance so that depth of insertion of the pin or socket can be limited.

DESCRIPTION OF THE PREFERRED EMBODIMENT

Figure 1:
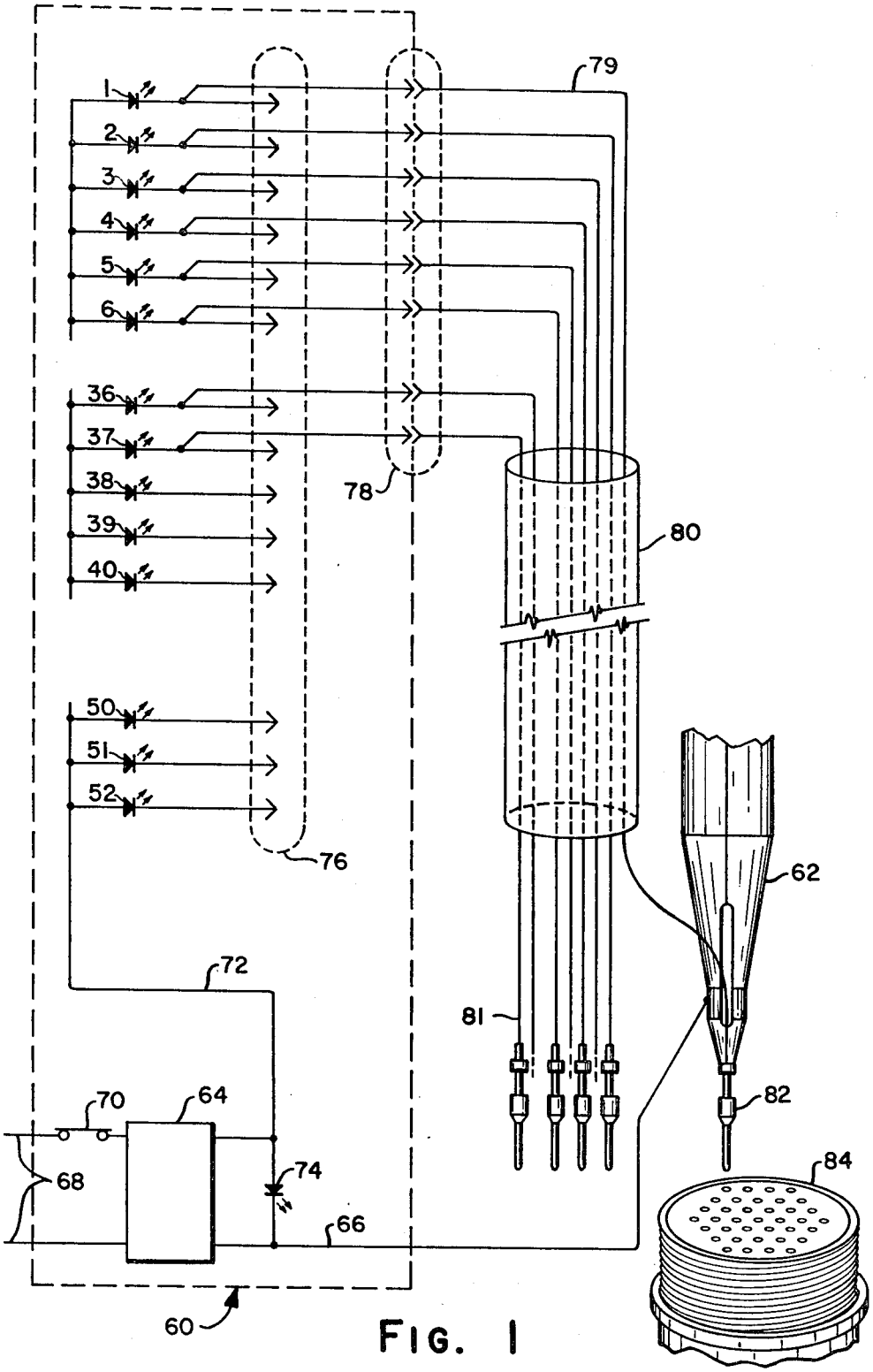
FIG. 1 is an electrical schematic of an element insertion location apparatus.

Referring to the drawing, there is depicted therein an element insertion location apparatus 60 designed as best seen schematically in FIG. 1. Element insertion location apparatus 60 is used in conjunction with an element insertion tool 62 in the manufacture of cables. Element insertion tool 62 is grounded to power supply 64 by conductor 66. Power supply 64 is connected across a voltage source by leads 68. Switch 70 turns power supply 64 on or off. Power supply 64 converts the incoming alternating current voltage to a low level direct current voltage and applies the direct current voltage on the order of 5 volts to output conductor 72. Power on light emitting diode 74 lights when conductor 72 is energized indicating that the power supply is turned on and is operating. Conductor 72 energizes the anode of each of light emitting diodes 1 through 52. The cathode of each light emitting diode 1 through 52 is wired to an element of cable connector 76. Cable connector 76 is a fifty-two conductor cable connector. In addition, the cathode of each light emitting diode 1 through 37 is wired to an element of cable connector 78. Cable connector 78 is a thirty-seven conductor cable connector.

FIG. 1 shows a completed first end 79 of thirty-seven conductor cable 80 connected to cable connector 78. The completed first end 79 of a cable 80 can be either a cable connector with sockets attached to the conductors and inserted in the cable connector, or a cable connector with pins attached to the conductors and inserted in the cable connector.

When element 82, either a pin or a socket, is placed in electrical contact with grounded element insertion tool 62, an electrical circuit is completed illuminating one light emitting diode of light emitting diodes 1 through 52. FIG. 1 shows a completed circuit with light emitting diode 1 illuminated; grounded element insertion tool 62 is shown as but not limited to a press.

Figure 2:
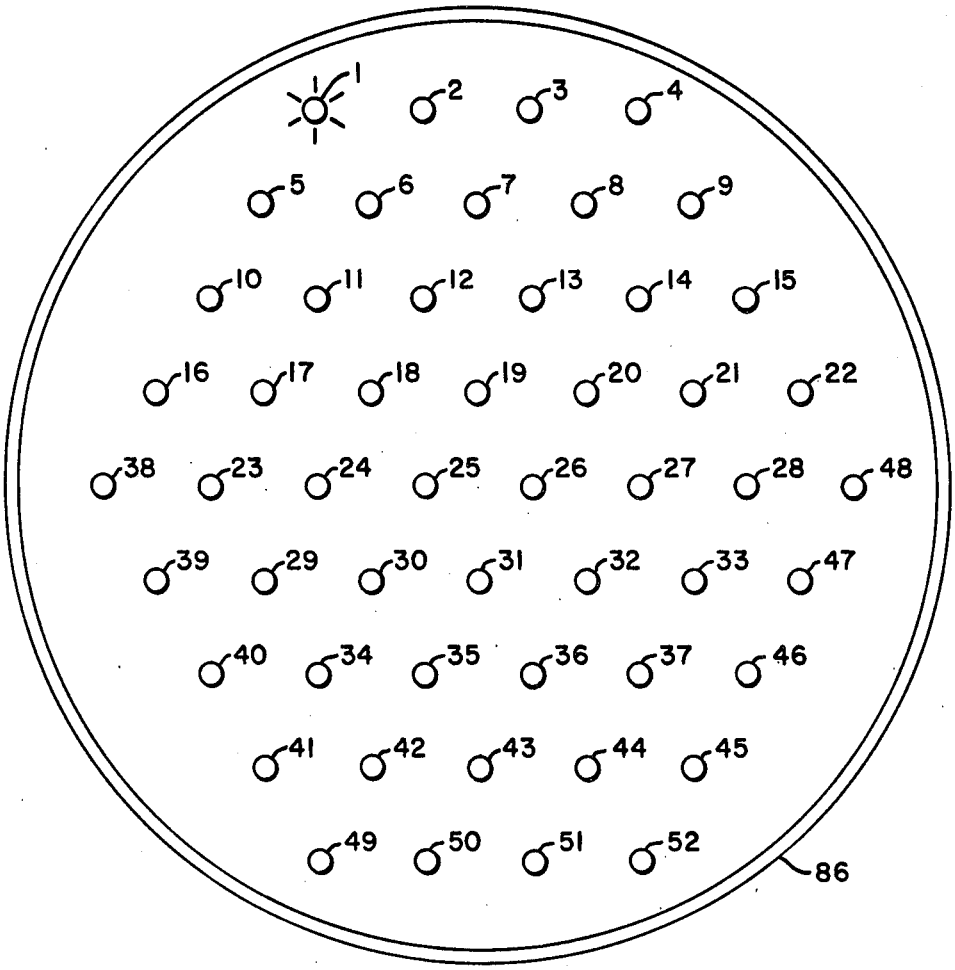
FIG. 2 is a physical arrangement of the light emitting diodes shown in FIG. 1 representing the element insertion locations of a cable connector.

FIG. 2 shows the physical arrangement of light emitting diodes 1 through 52. The physical arrangement of light emitting diodes 1 through 52 within array 86 correspond to element insertion locations in a cable connector. The physical array 86 of light emitting diodes in FIG. 2 is used to determine the element insertion location for both thirty-seven conductor and fifty-two conductor cables. For this reason, it is necessary that a light emitting diode 1 through 52 representing a physical location in array 86 of FIG. 2 be wired to the corresponding element in cable connector 76 or 78. A line of demarcation can indicate the various element insertion location configurations or light emitting diodes of one color can indicate a first configuration while light emitting diodes of another color supplement the first configuration to indicate a second configuration. The latter has been used where light emitting diodes 1 through 37 are red representing the element configuration for a thirty-seven conductor cable while light emitting diodes 38 through 52 are green and supplement the thirty-seven element configuration to represent a fifty-two element configuration.

The physical arrangement of light emitting diodes 1 through 37 in FIG. 2 correspond to the element insertion locations on the top surface of cable connector 84 of FIG. 1. During the fabrication of a second end 81 of a cable 80, upon placing element 82 in element insertion tool 62, the appropriate location to insert element 82 in cable connector 84 is instantly identified in the physical array 86 of light emitting diodes 1 through 52 by an illuminated light emitting diode as best seen in FIG. 2. This reduces the time required to fabricate the second end 81 of the cable 80 by eliminating the randomness formerly associated with determining the appropriate location for insertion of an element 82.

Upon removing element 82 from contact with grounded element insertion tool 62, such as after element 82 has been inserted in cable connector 84, the formerly completed circuit is opened and the corresponding formerly illuminated light emitting diode turns off. The procedure is ready for repeating with a different element 82. Hence, only one of the light emitting diodes 1 through 52 in array 86 is illuminated at a time. Furthermore, when all elements 82 have been inserted in cable connector 84, cable connector 84 can be inverted and ground conductor 66 placed in contact with each element 82, one after another, as a check to insure that elements 82 were inserted in the proper location. During this check, the array of light emitting diodes shown in FIG. 2 is read backwards.

Although element insertion tool 62 may be a screwdriver-like tool, a plier-like tool or a press, cable fabrication is further enhanced when element insertion location apparatus 60 is used in conjunction with the below-described press element insertion apparatus.

Figure 3:
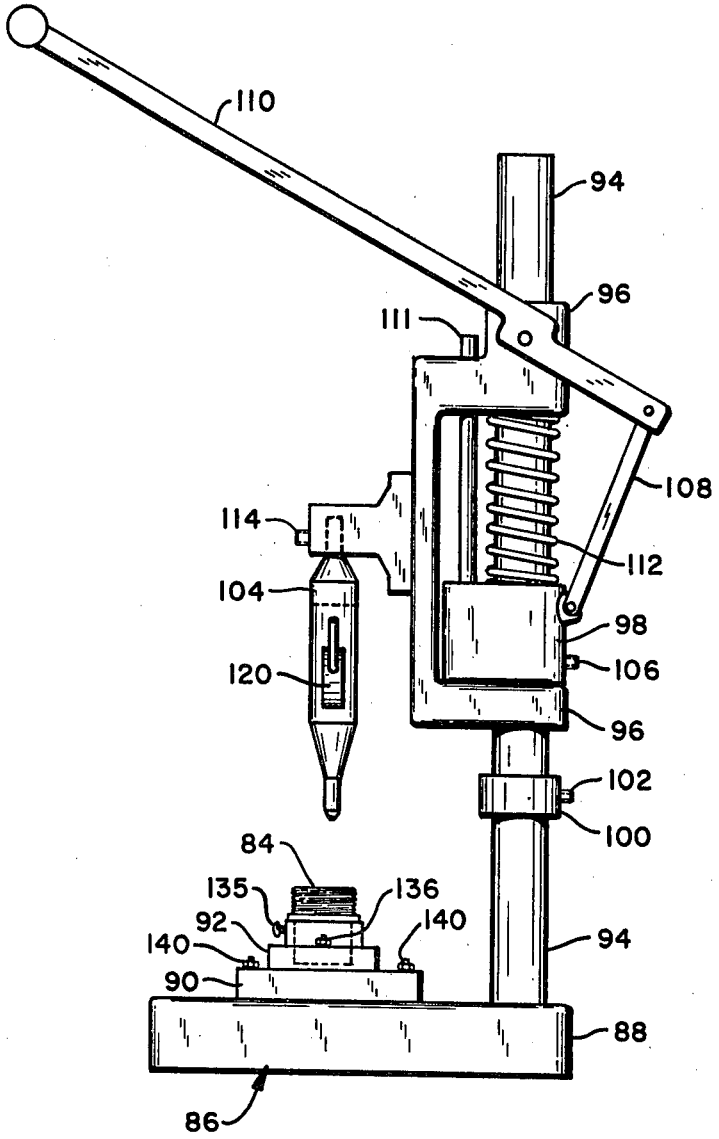
FIG. 3 is a side view of an element insertion apparatus embodying the present invention.

Referring to the drawing, there is depicted therein a press element insertion apparatus 86 in accordance with the present invention as best seen in FIG. 3. Base 88 supports a two-axis cable connector support position guide which prevents cable connector 84 from rotating during the fabrication process. Base 88 supports member 90 which restrains motion of cable connector 84 to a first direction. Member 90 supports member 92 which restrains motion of cable connector 84 to a second direction substantially perpendicular to the first direction. Member 92 supports cable connector 84. Base 88 also supports column 94.

Column element 96 is slidably engaged on column 94 and travels through a limited distance constrained by the lower portion of column element 96 between the lower surface of column bracket 98 and the upper surface of depth stop bracket 100. Depth stop bracket 100 is adjusted to limit the depth of insertion of an element in cable connector 84. Depth stop bracket 100 is retained in the desired position by depth stop bracket lock screw 102. The position of column bracket 98 on column 94 is selected to provide clearance between the lower end of element 82 and the upper surface of cable connector 84 with element 82 inserted in jaw clamp 104. Column bracket 98 is retained in its desired position by column bracket lock screw 106.

Connecting member 108 pivots both on column bracket 98 and handle 110. Handle 110 also pivots at a midpoint on column element 96 such that when the handle is moved toward base 88, column element 96 is caused to slide along column 94 and guide 111 toward base 88 compressing spring 112. Guide 111 is supported by column bracket 98 and prevents column element 96 from rotating around column 94. When element 82 is released from jaw clamp 104 and handle 110 is released, spring 112 which surrounds column 94 and is disposed between column bracket 98 and column element 96 causes column element 96 and handle 110 to return to their original position.

Jaw clamp 104 is mounted on column element 96 and is thereby constrained to move parallel to column 94 substantially perpendicular to the top surface of cable connector 84. Jaw clamp set screw 114 holds jaw clamp 104 in column element 96 and facilitates removing jaw clamp 104.

Figure 4:
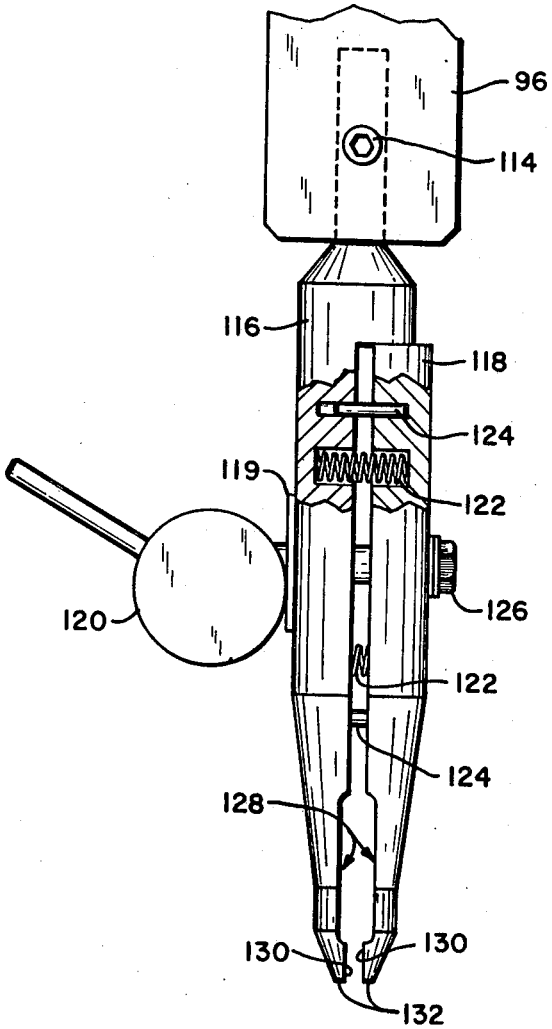
FIG. 4 shows the jaws of the element insertion apparatus of FIG. 3 in the open position.

Jaw clamp 104 is shown in the open position in FIG. 4. Stationary jaw member 116 is supported by column element 96. Movable jaw member 118 is supported by jaw member 116 and moves laterally when lever operated cam 120 is moved to its upper position. Internal springs 122 cause movable jaw member 118 to move away from stationary jaw member 116 as guided by internal guide pins 124 and limited by bolt 126 on which cam 120 pivots. Cam 120 rides on low friction guide 119. The lower portion of both stationary jaw member 116 and movable jaw member 118 is tapered to accommodate working in the limited area of a partially completed cable connector 84. Surfaces 128 form a recessed region in each jaw member 116 and 118. The recessed region formed by surfaces 128 accommodates the conductor connected to element 82 being inserted in cable connector 84. Surfaces 130 are concave to grip and hold element 82 with a conductor attached when jaw members 116 and 118 are closed. Surfaces 132 are flat to butt against the insertion shoulder of element 82.

Figure 5:
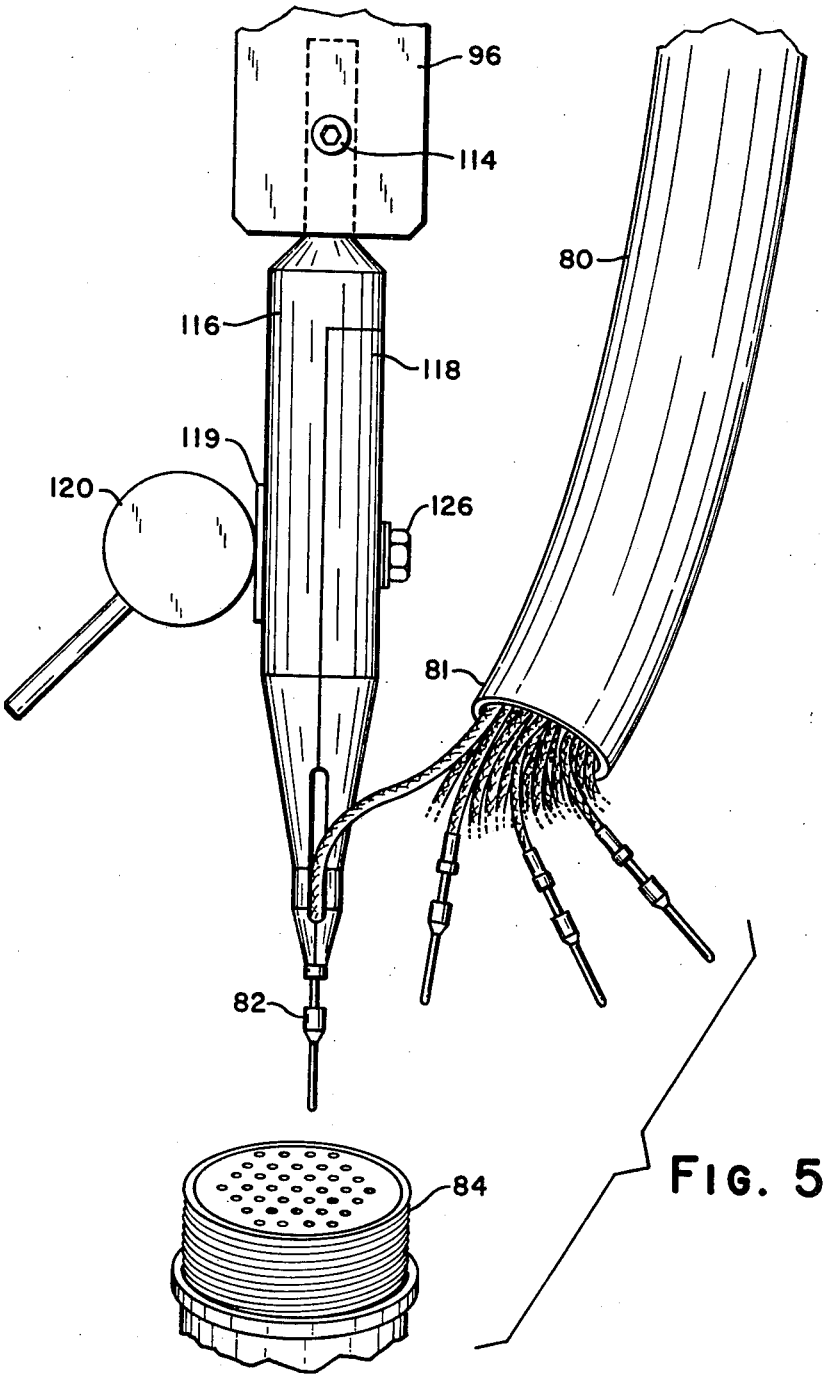
FIG. 5 shows the jaws of the element insertion apparatus of FIG. 3 in a closed position.

FIG. 5 shows jaw clamp 104 in the closed position holding element 82. Jaw clamp 104 securely holds element 82 between surfaces 130 during insertion in cable connector 84.

As can be seen from FIG. 2, the physical arrangement of elements in a cable connector can be symmetrical. To assure that the elements 82 are inserted in cable connector 84 in the proper location, it is imperative when working with the second end of cable that cable connector 84 not rotate during fabrication. However, since the element insertion array 86 is two dimensional and two elements are not inserted in the same location, it is necessary to provide cable connector 84 with two degrees of freedom.

Figure 6:
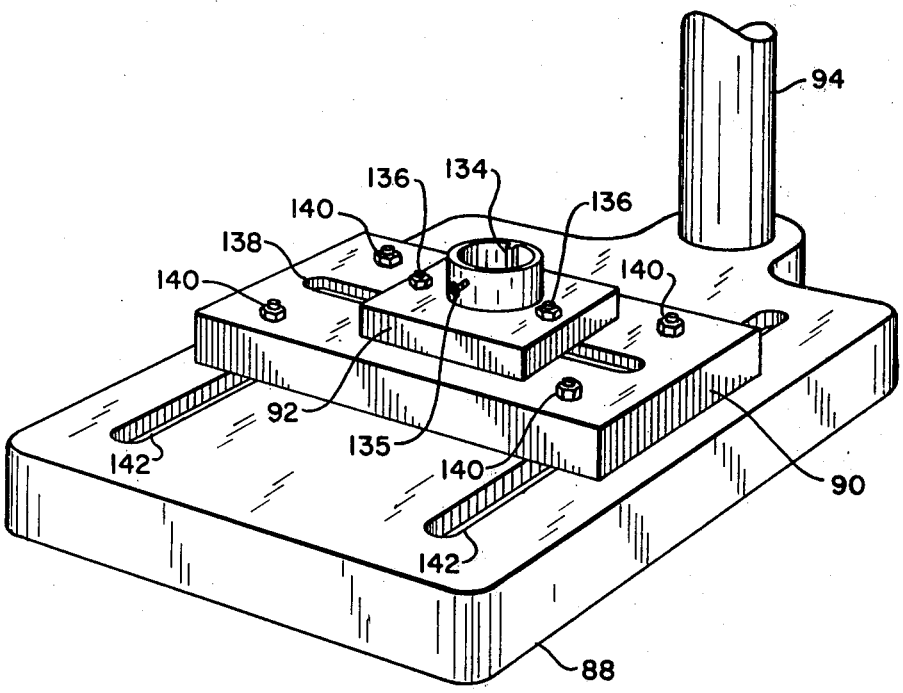
FIG. 6 shows the two-axis cable connector support position guide.

As best seen in FIG. 6, a key way in the barrel of cable connector 84 is aligned with key 134 on the internal diameter of member 92 preventing cable connector 84 from rotating relative to member 92. Locking wing bolt 135 is tightened to secure cable connector 84 in member 92. Member 92 is slidably engaged with member 90. Member 90 constrains member 92 to move in one degree of freedom as bolts 136 slide in slot 138 of member 90.

Member 90 is slidably engaged with base 88. Member 90 is constrained to one degree of freedom substantially perpendicular to slot 138 by bolts 140 which slide in slots 142. In this manner, cable connector 84 cannot rotate during the cable fabrication process and the array of element insertion locations on the top surface of cable connector 84 retains the same orientation as the physical arrangement 86 in FIG. 2 during the cable fabrication process.

Even though it is not necessary to prevent cable connector 84 from rotating during the fabrication of a first end of a cable, the rotation preventing apparatus of FIG. 6 can still be used.

Although press element insertion apparatus 86 can be used by itself, cable fabrication is particularly enhanced when press element insertion apparatus 86 is used in conjunction with the above described element insertion location apparatus 60.

Element insertion location apparatus 60 and press element insertion apparatus 86 have been described with reference to thirty-seven and fifty-two conductor cables. It is within the scope of the invention that one skilled in the art could apply the invention to fabricate multiconductor cables with any number of conductors and any element configuration.

We claim:

1. In apparatus for fabricating a cable, a press for inserting an element attached to the end of a conductor of the cable into a cable connector comprising:

(a) a base;

(b) a column mounted on a substantially perpendicular to the base;

(c) a two-axis position guide for supporting the cable connector on the base so as to prevent the cable connector from rotating, the two-axis position guide located on the base adjacent the column;

(d) means for holding an element attached to the end of a conductor of the cable having a stationary jaw member with a recessed region to accommodate a conductor and having a movable jaw member supported by the stationary jaw member with a recessed region to accommodate a conductor;

(e) means slidably engaged on the column for supporting the holding means;

(f) means for restraining the motion of the slidably engaged support means substantially perpendicular to the two-axis position guide; and (g) means for moving the slidably engaged support means through a limited distance along the column.

2. An apparatus as recited in claim 1 wherein the two-axis position guide is comprised of:

(a) a first member slidably engaged on the base and constrained to move in a first degree of freedom; and (b) a second member slidably engaged on the first member for receiving a cable connector, the second member constrained to move in a second degree of freedom, the second degree of freedom being substantially perpendicular to the first degree of freedom.

3. An apparatus as in claim 2 wherein the second member of the two-axis position guide includes a key that mates with a key way on the barrel of a cable connector.

4. An apparatus as recited in claim 2 or 3 wherein the second member of the two-axis position guide includes a thumb screw to secure the cable connector in the second member.

5. An apparatus as recited in claim 1 wherein the element holding means includes means for operating the movable jaw member.

6. An apparatus as recited in claim 5 wherein the operating means is a lever operated cam.

7. An apparatus as recited in claim 5 or 6 wherein a spring resilient means is inserted between the movable jaw member and the stationary jaw member.

8. An apparatus as recited in claim 1 wherein the means for moving the slidably engaged support means is comprised of:

(a) a first position adjustable member secured to the column;

(b) a second position adjustable member secured to the column;

(c) a linking member pivotally attached at a first end to one of the position adjustable members; and (d) a lever pivotally attached at one end to the second end of the linking member, the lever pivotally attached at a midpoint to the slidably engaged support means.

9. An apparatus as recited in claim 8 wherein the linking member is pivotally attached to the first position adjustable member.

10. An apparatus as recited in claim 9 wherein a spring resilient means is disposed between the first position adjustable member and the slidably engaged support means.

11. An apparatus as recited in claim 8 or 9 wherein the slidably engaged support means is constrained to move between the first position adjustable member and the second position adjustable member.

12. An apparatus as recited in claim 8 wherein the means for constraining the motion of the slidably engaged support means substantially perpendicular to the cable connector support means is a guide supported by the first position adjustable member.

* * * * *